United States Patent [19]

Kawamura

[11] Patent Number: 4,531,907

[45] Date of Patent: Jul. 30, 1985

[54] FLUIDIZED BED COMBUSTOR

[75] Inventor: Yoshio Kawamura, Ibaraki, Japan

[73] Assignee: Agency of Industrial Science & Technology, Ministry of International Trade & Industry, Tokyo, Japan

[21] Appl. No.: 657,249

[22] Filed: Oct. 3, 1984

[30] Foreign Application Priority Data

Oct. 7, 1983 [JP] Japan ..... 58-187985

[51] Int. Cl.[3] ..... F23D 19/00

[52] U.S. Cl. ..... 431/170; 431/7; 110/244; 422/144; 422/145; 432/16; 432/17; 432/71; 432/58

[58] Field of Search ..... 431/7, 170, 328; 432/14, 16, 17, 58, 68, 71; 122/4 D; 110/243, 244; 34/10, 57 R, 57 C; 422/144, 145, 146

[56] References Cited

U.S. PATENT DOCUMENTS

| | | | |
|---|---|---|---|
| 2,587,378 | 2/1952 | Petersen | 432/68 X |
| 2,763,478 | 9/1956 | Parry | 432/58 |
| 3,977,947 | 8/1976 | Pyle | 432/58 X |
| 4,227,488 | 10/1980 | Stewart et al. | 431/170 X |
| 4,304,754 | 12/1981 | Jukkola | 432/58 X |
| 4,321,233 | 3/1982 | Tsuji et al. | 431/7 X |
| 4,330,502 | 5/1982 | Engstrom | 431/7 X |
| 4,338,074 | 7/1982 | Johansson | 431/7 X |
| 4,445,844 | 5/1984 | Matthews | 431/7 X |
| 4,457,289 | 7/1984 | Korenberg | 431/7 X |
| 4,490,157 | 12/1984 | Fernandes | 431/7 X |

*Primary Examiner*—Randall L. Green

*Attorney, Agent, or Firm*—Schwartz & Weinrieb

[57] ABSTRACT

A fluidized bed combustor is adapted to deprive a combustion gas issuing therefrom of dust by bringing the combustion gas into contact with a filter medium which is a fluidizing solid discharged in conjunction with slagging ash out of the combustor.

14 Claims, 2 Drawing Figures

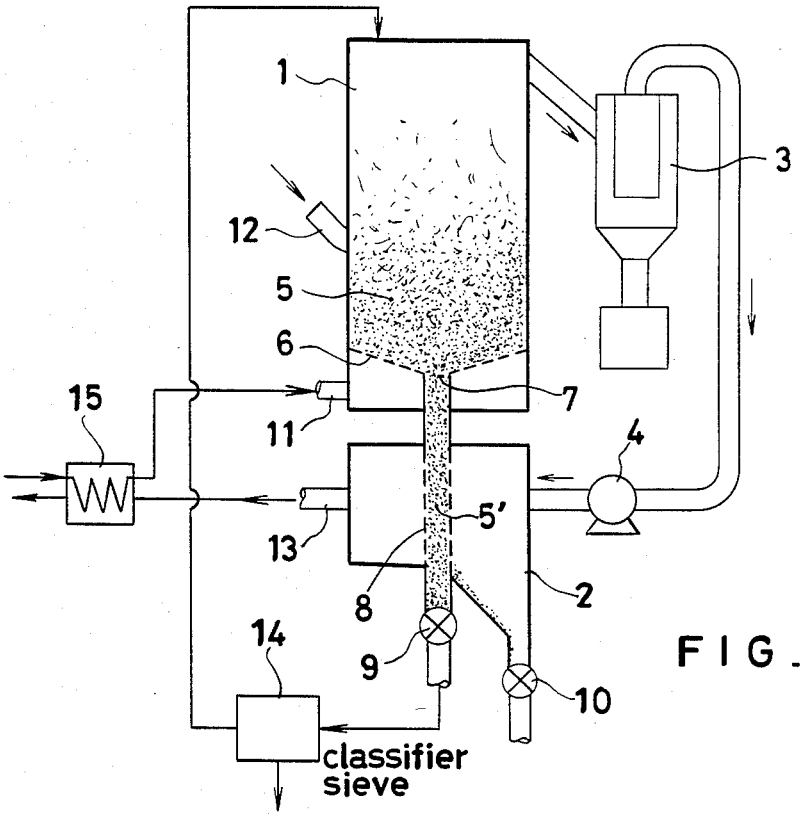
FIG. 1
FIG. 2
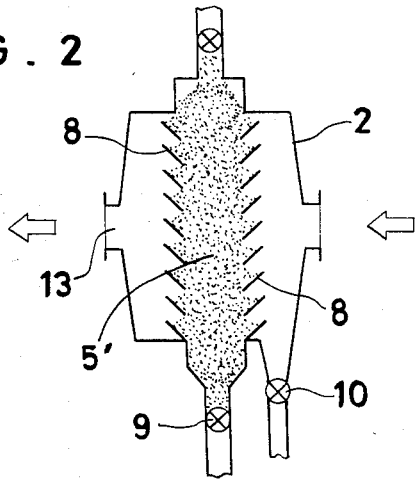

FLUIDIZED BED COMBUSTOR

FIELD OF THE INVENTION

This invention relates to a fluidized bed combustor.

BACKGROUND OF THE INVENTION

As a method for carrying out combustion while holding the emission of pollutants to a low level, fluidized bed combustion is advantageous over other methods of combustion in many points. It nevertheless suffers from certain disadvantages.

First, since this method uses limestone as the fluidizing solid, the $SO_x$ produced in consequence of combustion of fuel containing sulfur, though removable to some extent, is removed with poor efficiency as compared with the method of wet flue gas desulfurization.

When fuel containing ash is burned within the fluidized bed, part of the ash is converted into a slagging material because of the intense heat and is deposited on the bottom of the fluidized bed. This heavy ash must be removed from the bottom of the fluidized bed but during removal it is impossible to avoid discharge of the hot fluidizing solid from the fluidized bed. Thus, the removal not only impairs the thermal efficiency of the operation but also proves disadvantageous from an economic point of view.

The greater part of the ash produced on the fluidized bed is entrained by the waste gas and discharged from the furnace interior. Since this ash contains fine particles which cannot be thoroughly arrested by the cyclone ash collector alone there is no way to obtain efficient removal of this ash in the dry method other than to use a bag filter or an electric precipitator. The ordinary bag filter suffers from heavy pressure loss and generally has a low working temperature not exceeding 200° while the heat-resistant bag filter is expensive. Moreover, electric precipitators are very expensive, though they have low pressure loss and provide outstandingly efficient recovery of dust.

OBJECT OF THE INVENTION

An object of this invention is to provide a fluidized bed combustor incorporating means for the efficient collection of ash and which, therefore, has low heat loss.

SUMMARY OF THE INVENTION

According to the fluidized bed combustor of this invention, during the removal from the fluidized bed of the heavy ash formed therein, the fluidizing solid which is entrained by the heavy ash being so removed is utilized as a filter medium for the removal of dust from the waste gas issuing from the fluidized bed combustor, the heat retained by the fluidizing solid being discharged as entrained by the heavy ash is allowed to pass into the waste gas, and the waste gas consequently heated is used to heat the combustion air or the feed water to a boiler by means of heat exchange. Thus, the fluidized bed combustor is able to make optimum use not only of the fluidizing solid discharged from the fluidized bed but also of the heat retained by the fluidizing solid so discharged.

BRIEF DESCRIPTION OF THE DRAWINGS

The other objects and characteristic features of the present invention will become apparent to those skilled in the art as the disclosure is made in the following description of a preferred embodiment of the invention, as illustrated in the accompanying drawings, wherein:

FIG. 1 is a schematic structural diagram illustrating a fluidized bed combustor as a typical embodiment of this invention.

FIG. 2 is an explanatory view illustrating the conduction in which the combustion gas is filtered by a filter medium.

DESCRIPTION OF PREFERRED EMBODIMENT

FIG. 1 represents a fluidized bed combustor as a typical embodiment of the present invention. Air is supplied through an air feed inlet 11 as indicated by the arrow into a fluidized bed combustor 1 where it is used to burn, as fluidized together with a fluidizing solid 5, a solid fuel (mainly coal) supplied through a fuel feed inlet 12 and deposited on a fluidized bed. The ash originating in the fuel and the finely pulverized portion of fluidizing solid 5 are cooled together with the combustion gas to a suitable temperature such as, for example, 200° C. and led into a cyclone dust collector 3. The particles of the ash and the pulverized fluidizing solid in the combustion gas which exceed 30 μm in diameter are substantially wholly collected in the cyclone dust collector 3.

The combustion gas containing fine solid particles which have escaped removal by the cyclone dust collector 3 is compressed by a blower 4 and forwarded to a filtering dust collector 2 disposed below the fluidized bed combustor 1.

The ash contained in the fuel inside the fluidized bed 5 in consequence of the combustion is preponderantly entrained as described above by the combustion gas and drawn into and arrested by the cyclone dust collector 3. However, part of the ash is locally heated and converted into a slagging material and retained in the fluidizing solid 5. Thus, the slagging material accumulates upon the furnace bottom 6. Since the accumulated heavy ash impairs the fluidity of the fluidized bed, it is discharged together with the fluidizing solid through an outlet 7 disposed in the furnace bottom 6 under the control of a discharge volume regulating valve 9.

The fluidizing solid, while being discharged together with the heavy ash via the outlet 7 passes through the filtering dust collector 2 where it is used as a filter medium 5' for the combustion gas being introduced into the filtering dust collector 2 to separate the dust from the combustion gas.

To be more specific, inside the filtering dust collector 2, the filter medium 5' moves down the interior of a hollow support frame 8 formed of perforated plates, metallic net, louvers, or other suitable materials pervious to air in conjunction with the ash and, in the meantime, the combustion gas from the dust collector 2 is accelerated by the blower 4 and blown perpendicularly to the aforementioned support frame 8, with the result that the dust in the combustion gas is caught by the fluidizing solid inside the support frame 8 and the combustion gas now free from the dust is released from the filtering dust collector 2 via an outlet 13. The combustion gas, while in contact with the fluidizing solid, is heated by the heat retained by the fluidizing solid.

As the fluidizing solid there is generally used limestone adjusted to a particle diameter of not more than 3 mm. The filter medium which is formed of the fluidizing solid has a thickness on the order of 10 to 30 cm and is capable of arresting about 98% of the dust contained in the combustion gas, which has an average particle diameter of 20 μm. Since an excessive increase in the thickness of this filter medium results in an increased pressure loss, it is desirable to divide the filter medium into a plurality of layers each of a sufficiently small thickness rather than to use one of large thickness.

The speed at which the fluidizing solid moves down the interior of the support frame 8 is controlled by adjusting the opening of the valve 9 so that the support frame will be kept filled with the heavy ash and fluidizing solid at all times. The speed of the movement of the fluidizing solid through the interior of the support frame is further adjusted in accordance with the amount of dust contained in the combustion gas.

The support frame 8 is provided on the inlet side and/or outlet side thereof relative to the flow of the combustion gas with a louver as means for moderating the pressure with which the combustion gas collides against the filter medium and preventing the fluidizing solid from escaping through openings in the support frame and being diffused inside the dust collector 2 (FIG. 2).

The used filter medium and the dust caught thereon are forwarded to a classifier sieve 14. The portion of the used filter medium separated out as reclaimed fluidized solid is returned to the fluidized bed combustor 1 and used again. On its way to the classifier sieve 14, the used filter medium must be cooled. Conveniently, it is cooled by being contacted with the cooled combustion gas.

The dust which adheres to the combustion gas inlet side surface of the filter medium gradually falls and accumulates in the lower part of the filtering dust collector 2. The accumulated dust is continuously discharged through a discharge valve 10 lest it should rise so much as to impair the function of the filtering dust collector 2.

In the illustrated embodiment, the combustion gas released through the outlet 13 of the filtering dust collector 2 and heated by contact with the filter medium is utilized in an air preheater 15 for heating the combustion air by means of heat exchange. Optionally, this combustion gas may be used for the purpose of preheating the water which is to be heated by the combustor.

In the embodiment so far described only one outlet is provided for the discharge of the fluidizing solid. Other embodiments using a plurality of outlets are also possible. These include an embodiment which has such a plurality of outlets open into one filter layer, an embodiment which has a plurality of outlets open into two or more filter layers, and an embodiment which has a plurality of outlets open into two or more separate filtering dust collectors. In any of these embodiments, when a plurality of fluidized beds are formed, it becomes necessary for all of the outlets to be severally provided at the outer ends thereof with a discharge stop valve because of the possibility that some of the plurality of fluidized beds will become inoperable when the combustor is operated under low load.

In the fluidized bed combustor described above, the fluidizing solid which is entrained by the heavy ash formed within and removed from the fluidized bed combustor is utilized as the filter medium for the removal of the dust contained in the combustion gas. Thus, the pollutant contents of the waste gas released from the combustor into the ambient air can be amply lowered below the emission standard without necessitating use of a bag filter or an electric precipitator. When limestone is used as the fluidizing solid, since the limestone is calcined and converted into quick lime during fluidized bed combustion, the layer of filter medium formed with the fluidizing solid discharged from the fluidizing bed naturally consists of quick lime. Thus, the layer of filter medium proves additionally effective for the absorptive removal of $SO_x$ contained in the combustion gas.

Now, one example of this invention will be cited. In a fluidized bed combustor having a bed area of about 0.21 $m^2$, coal crushed to a particle size of 1 to 10 mm was fed in at a rate of about 30 kg/hour via a fuel feed inlet and air for combustion was introduced at a rate of 380 kg/hour via a feed inlet in the lower part of the combustor and the coal was burned with limestone 1 mm in medium diameter used as a fluidizing solid. During the combustion, the limestone was replenished at the averaged rate of about 3 kg/hour.

The combustion gas from the fluidized bed combustor had a flow volume of about 404 kg/hour and a temperature of about 850° C. It was cooled to about 250° C. and then forwarded to a cyclone dust collector. The combustion gas contained 20 to 30 $g/m^3$ of dust. The dust particles exceeding 30 μm in particle diameter were arrested within the cyclone dust collector. The combustion gas departing from the cyclone dust collector contained 2 to 3 $g/m^3$ of dust particles having an average particle diameter of 20 μm. At this time, the pressure loss of the combustion gas was 70 $mmH_2O$. The combustion gas had a temperature of about 200° C. It was accelerated with a blower to a rate of 404 kg/hour and blown in the direction of the filter medium formed inside a support frame. The front and rear sides of the support frame were each formed of a louver. The support frame was 70 cm in width and 15 cm thickness. Through the interior of this support frame, heavy ash and fluidizing solid moved down at a combined rate of 35 kg/hour. Of the fluidizing medium, the portion which was separated as reclaimable was circulated back into the combustor interior. The combustion gas, by being passed through the filter medium formed inside the support frame, had its dust content lowered to below 0.1 $g/m^3$ and the temperature thereof elevated to about 250° C. The combustion gas was then caused to exchange heat with the air for combustion, enabling the temperature of the air to be increased by about 80° C.

Obviously, many modifications and variations of the present invention are possible in light of the above teachings. It is therefore to be understood that within the scope of the appended claims, the present invention may be practiced otherwise than as specifically described herein.

What is claimed is:

1. A fluidized bed combustion system, comprising:

a fluidized bed combustor;

first outlet means operatively connected to said fluidized bed combustor for discharging slagging ash and fluidized solids from said fluidized bed combustor;

second outlet means operatively connected to said fluidized bed combustor for discharging combustion gas from said fluidized bed combustor;

a filtering dust collector having an inlet operatively connected to said second outlet means of said fluidized bed combustor for receiving said combustion gas discharged from said fluidized bed combustor, and an outlet for discharging filtered combustion gas; and perforate means, operatively connected to said first outlet means of said fluidized bed combustor for receiving said slagging ash and fluidized solids discharged from said fluidized bed combustor, disposed interiorly of said filtering dust collector such that said perforate means and said discharged slagging ash and fluidized solids serve as a filtering medium for said combustion gas from said fluidized bed combustor as said combustion gas flows through said filtering dust collector and said perforate means from said filtering dust collector inlet to said filtering duct collector outlet.

2. A fluidized bed combustion system as set forth in claim 1, wherein:

said fluidized bed combustor is disposed vertically;

said first outlet means is disposed at the bottom of said vertically disposed fluidized bed combustor; and said second outlet means is disposed at the top of said vertically disposed fluidized bed combustor.

3. A fluidized bed combustion system as set forth in claim 1, additionally comprising:

cyclone means operatively interposed between said second outlet means of said fluidized bed combustor and said inlet of said filtering dust collector for separating coarse dust particles from fine dust particles.

4. A fluidized bed combustion system as set forth in claim 3, additionally comprising:

blower means operatively interposed between said cyclone means and said inlet of said filtering dust collector for conducting said combustion gas, containing said fine dust particles, to said filtering dust collector.

5. A fluidized bed combustion system as set forth in claim 1, further comprising:

means operatively disposed within said first outlet means of said fluidized bed combustor for controlling the flow of said slagging ash and fluidized solids through said first outlet means of said fluidized bed combustor.

6. A fluidized bed combustion system as set forth in claim 5, wherein:

said controlling means comprises an adjustable valve.

7. A fluidized bed combustion system as set forth in claim 1, further comprising:

sieve means operatively connected to said first outlet means of said fluidized bed combustor for separating said slagging ash from said fluidized solids.

8. A fluidized bed combustion system as set forth in claim 7, further comprising:

means for recirculating said fluidized solids from said sieve means back to said fluidized bed combustor.

9. A fluidized bed combustion system as set forth in claim 7, wherein:

said sieve means is disposed downstream of said perforate means within the flow path of said slagging ash and fluidized solids through said first outlet means.

10. A fluidized bed combustion system as set forth in claim 1, wherein:

said perforate means comprises a serial array of louvers.

11. A fluidized bed combustion system as set forth in claim 1, further comprising:

heat exchange means operatively connected to said outlet of said filtering dust collector for conducting said filtered combustion gas therethrough; and fresh air inlet means disposed within said heat exchange means and operatively connected to said fluidized bed combustor for providing pre-heated combustion air to said fluidized bed combustor.

12. A fluidized bed combustion system as set forth in claim 1, additionally comprising:

additional outlet means operatively connected to said filtering dust collector for discharging dust particles removed from said filtered combustion gas.

13. A fluidized bed combustion system as set forth in claim 12, wherein:

said filtering dust collector outlet for said filtered combustion gas is disposed downstream of said perforate means, while said additional outlet means of said filtering dust collector for said dust particles is disposed upstream of said perforate means, within the flow path of said combustion gas through said filtering dust collector.

14. A fluidized bed combustion system as set forth in claim 1, wherein:

said fluidized solids comprises limestone.

* * * * *